US007686179B2

(12) United States Patent
Chen

(10) Patent No.: US 7,686,179 B2
(45) Date of Patent: Mar. 30, 2010

(54) STACKABLE RECEPTACLE

(76) Inventor: Ching-Tzu Chen, No. 7, Lane 107, Sec. 2, Jinhua Rd., Tainan (TW)

( * ) Notice: Subject to any disclaimer, the term of this patent is extended or adjusted under 35 U.S.C. 154(b) by 1265 days.

(21) Appl. No.: 11/145,717

(22) Filed: Jun. 6, 2005

(65) Prior Publication Data

US 2006/0272977 A1 Dec. 7, 2006

(51) Int. Cl.
*B65D 21/032* (2006.01)

(52) U.S. Cl. ..... 220/4.27; 206/509

(58) Field of Classification Search ..... 220/4.27, 220/630; 206/509

See application file for complete search history.

(56) References Cited

U.S. PATENT DOCUMENTS 1,849,659 A * 3/1932 Burks ..... 312/107
5,191,977 A * 3/1993 Markovitz ..... 206/308.1
5,287,980 A * 2/1994 Saltz ..... 220/4.27
6,039,202 A * 3/2000 Olstad et al. ..... 220/533
6,629,677 B2 * 10/2003 Kirshner ..... 248/116
7,311,202 B2 * 12/2007 Chen ..... 206/504

* cited by examiner

*Primary Examiner*—Stephen Castellano
(74) *Attorney, Agent, or Firm*—William E. Pelton, Esq.; Cooper & Dunham LLP

(57) ABSTRACT

A receptacle includes a pouch-like body having an opening, a cover pivotally connected to a side face defining the opening so as to close selectively the opening and a seat detachably connected to a bottom face of the pouch-like body to allow the pouch-like body to be slanted relative to a ground surface.

2 Claims, 4 Drawing Sheets

STACKABLE RECEPTACLE

BACKGROUND OF THE INVENTION

1. Field of the Invention

The present invention relates to a receptacle, and more particularly to a stackable receptacle having a first connecting device formed on a top thereof and a second connecting device formed on a bottom thereof so that engagement between the first connecting device and the second connecting device is able to securely engage two adjacent receptacles.

2. Description of Related Art

Garbage cans are specifically used to collect garbage and are not available for other applications. Therefore, once a garbage can is formed, its application is so limited that no one would want to use the garbage can for other purposes. Further, in order to have large garbage collecting capacity, the current garbage can has large dimensions, which makes it difficult to be stored in a compact space. To overcome that storage problem, different designs to alter the shape of the current garbage cans are introduced to the market. One of the designs is to allow the conventional garbage cans to be stacked on top of one another so as to diminish the occupied space.

This type of garbage can does fulfill the requirements to allow the garbage cans to be stored in a compact space and also facilitates the process of garbage recycling in that people are able to use multiple stacked garbage cans to store different types of garbage. However, when this type of conventional garbage can is employed, due to the unstable gravity center of the garbage can, the stacked garbage cans easily tip over.

To overcome the shortcomings, the present invention tends to provide an improved stackable garbage can to mitigate the aforementioned problems.

SUMMARY OF THE INVENTION

The primary objective of the present invention is to provide an improved receptacle which is stackable on top of one another.

In one aspect of the present invention, the receptacle of the present invention has a first connecting device formed on top thereof and a second connecting device formed on bottom thereof to correspond to the first connecting device of an adjacent receptacle so that the garbage can is able to securely sit on the adjacent garbage can.

In yet another aspect of the present invention, the receptacle has a seat provided on the bottom of the receptacle to allow the garbage can to be inclined relative to a ground surface.

Other objects, advantages and novel features of the invention will become more apparent from the following detailed description when taken in conjunction with the accompanying drawings.

DETAILED DESCRIPTION OF THE PREFERRED EMBODIMENT

Figure 1:
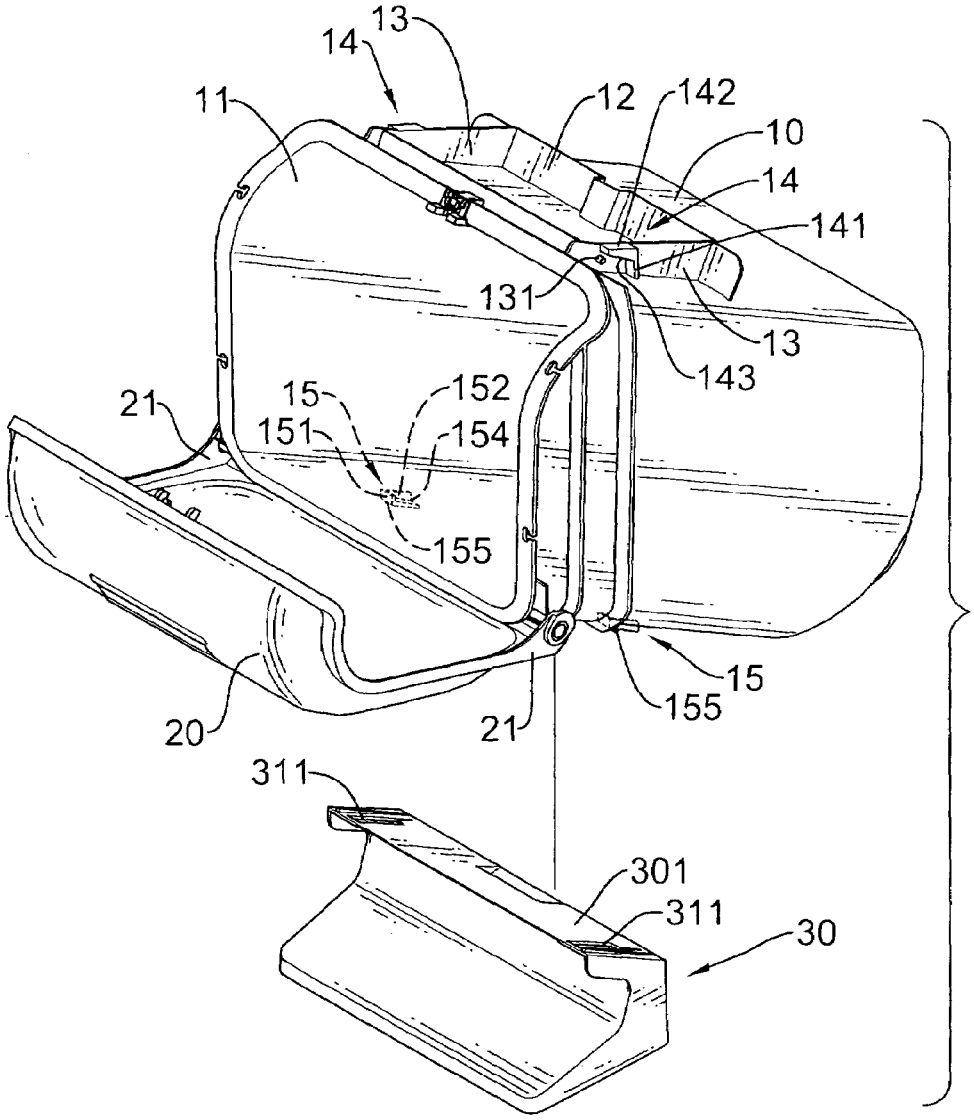
FIG. 1 is an exploded perspective view of the receptacle of the present invention.

With reference to FIG. 1, it is noted that the receptacle in accordance with the present invention includes a pouch-like body (10), a cover (20) pivotally connected to the body (10), a first connecting device (14) formed on a top face of the body (10) and a second connecting device (15) formed on a bottom face of the body (10). Furthermore, a seat (30) is provided to support the pouch-like body (10).

The pouch-like body (10) has an opening (11) and the cover (20) is pivotally connected to a side face defining the opening (11) by any method known in the art. Preferably, the cover (20) is provided with two bolts respectively extending through two opposite side faces (21) of the cover (20) and into the side face defining the opening (11) so allow the cover (20) to be pivotal relative to the body (10). Further, the body (10) has spacer wall (12) formed on a top face of the body (10) and two side walls (13) respectively extending from two ends of the spacer wall (12) to form together with the spacer wall (12) a substantial U-shape. The first connecting device (14) is formed on an outer side face of each of the two side walls (13) and has a stopping wall (141) extending out from the outer side face of the side wall (13), an arm (142) extending from a free end of the stopping wall (141) and a tapered bottom side (143) formed on a bottom face of the arm (142). The stopping wall (141) together with the arm (142) has an L-shaped cross section. A first boss (131) is also formed on the outer side face of each of the two side walls (13).

The second connecting device (15) is provided on two opposite sides of the bottom of the pouch-like body (10) and includes an engaging wall (151) formed on the bottom of the body (10), an extension (152) formed on a free end of the engaging wall (151) and a reduced bottom side (154) formed on a bottom of the extension (152). A second boss (155) is formed adjacent to the extension (152) to correspond to the first boss (131).

The seat (30) has an inclined top face (301) obliquely extending out relative to a bottom face of the seat (30) and two L-shaped grooves (311) defined in the inclined top face (301) to correspond to and receive therein the two second connecting devices (15).

Figure 2:
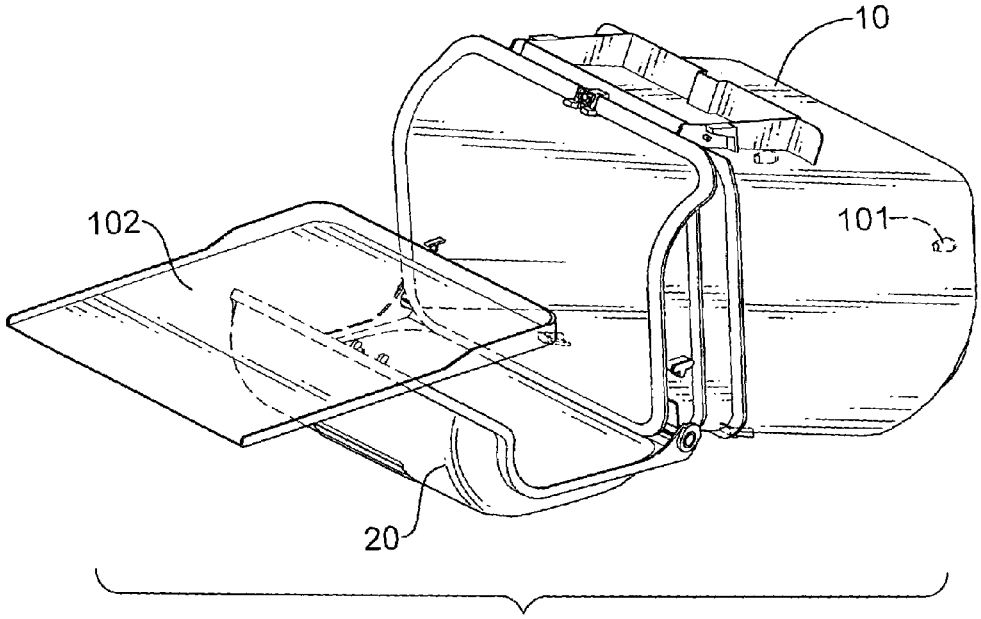
FIG. 2 is an exploded perspective view showing a different embodiment of the body of the receptacle.

With reference to FIG. 2, it is noted that inside the pouch-like body (10), multiple retainers (101) are formed on inner side faces of the body (10) so that a baffle (102) is able to be supported by the retainers (101) so as to divide an interior of the body (10) into two compartments for receiving objects of different natures.

Figure 3:
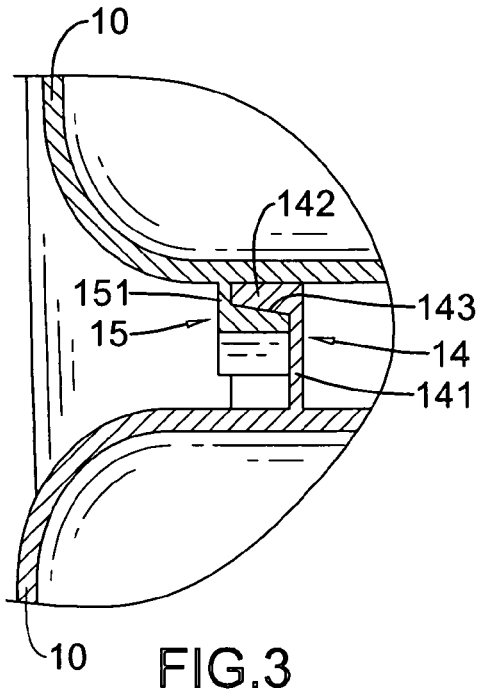
FIG. 3 is a schematic cross sectional view showing the engagement between the first connecting device and the second connecting device.
Figure 4:
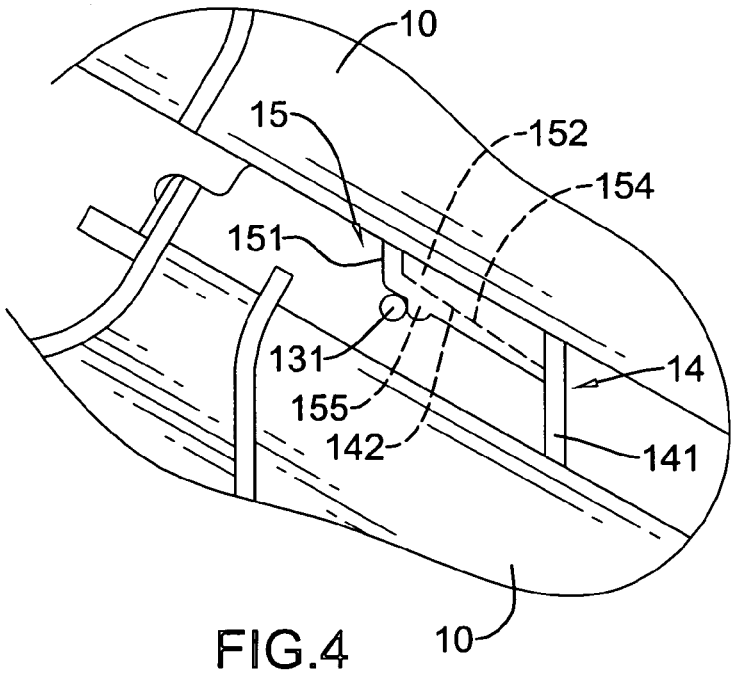
FIG. 4 is a schematic view showing that the second boss of the second connecting device is abutted by the first boss of the first connecting device so that two adjacent receptacles are secured.
Figure 5:
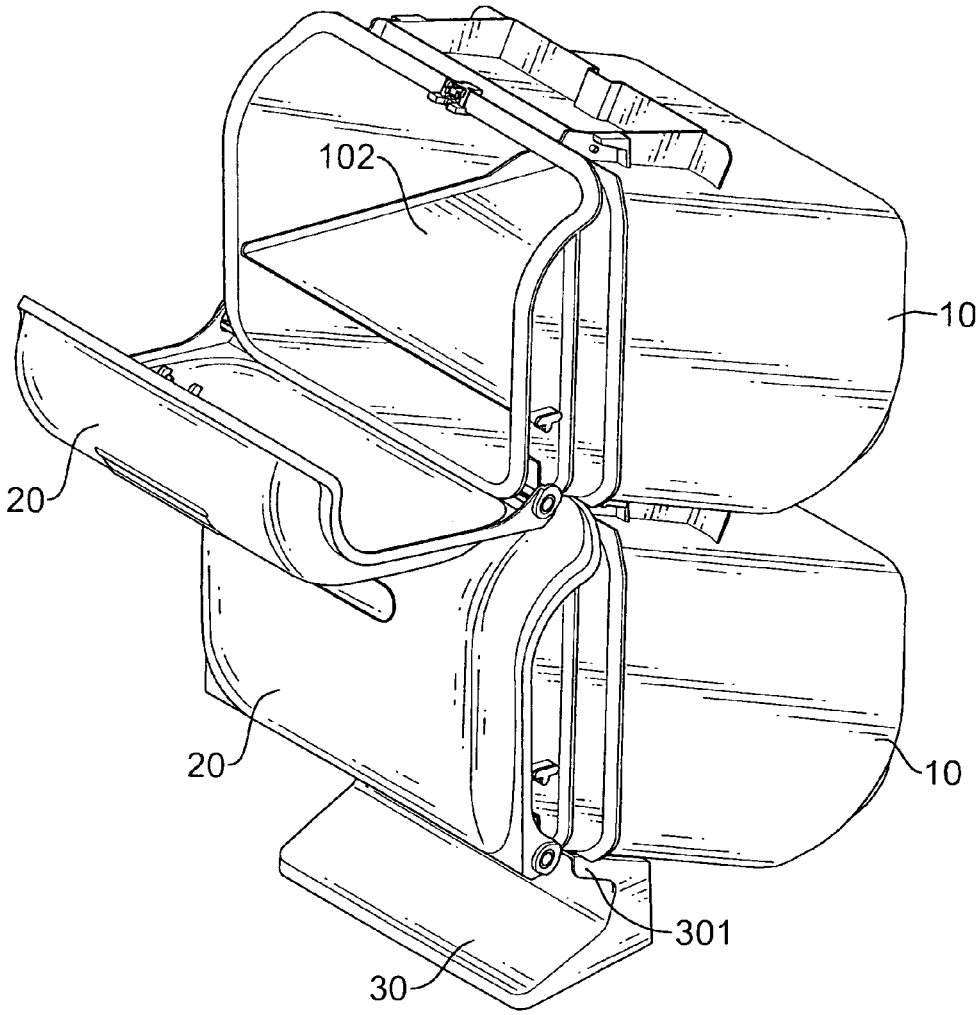
FIG. 5 is a perspective view showing that two receptacles are mutually stacked.

With reference to FIGS. 3, 4 and 5, it is noted that after the receptacle of the present invention is combined with the seat (30), each engaging wall (151) as well as the extension (152) of the respective second connecting devices (15) is received in the corresponding L-shaped groove (311) so as to secure the receptacle on top of the seat (30). Furthermore, due to the inclination of the inclined top face (301), the receptacle of the present invention is slanted relative to a ground surface. Still, if a second receptacle is to be stacked on top of the receptacle on top of the seat (30), the stopping wall (141) corresponds to the engaging wall (151) and the arm (142) corresponds to the extension (152) so that the arm (142) is received in a space defined by the engaging wall (151) and the extension (152). In addition, engagement between the tapered bottom side (143) of the first connecting device (14) and the reduced bottom side (154) facilitates the engagement between the first connecting device (14) and the second connecting device (15).

In order to prevent the second receptacle from sliding off the first receptacle should the engagement between the first connecting device (14) and the second connecting device (15) be not strong enough, engagement between the first boss (131) and the second boss (155) ensures that the first connecting device (14) is securely connected to the second connecting device (15).

Because of the seat (30), the receptacle of the present invention is inclined relative to the ground surface such that the objects contained inside the receptacle are safely enclosed. Furthermore, even after two or multiple receptacles are stacked on top of one another, due to the first connecting device (14) and the second connecting device (15), the engagement therebetween confirms the security of the two receptacles.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle comprising:

a pouch-like body having an opening;

a cover pivotally connected to a side face defining the opening so as to close selectively the opening; and a seat detachably connected to a bottom face of the pouch-like body to allow the pouch-like body to be slanted relative to a ground surface, wherein the pouch-like body has a first connecting device formed on a top surface of the pouch-like body and a second connecting device formed on a bottom face of the pouch-like body, said second connecting device corresponding to and received in the seat and receivable in a first connecting device of another receptacle when stacked therebelow;

the pouch-like body has a spacer wall formed on a top face of the pouch-like body and two side walls respectively extending from opposed ends of the spacer wall;

the second connecting device includes an engaging wall formed on the bottom of the body, an extension formed on a free end of the engaging wall and a reduced bottom side formed on a bottom of the extension so as to correspond to and be detachably received in a groove defined in an inclined top face obliquely formed on the seat relative to a ground surface;

the pouch-like body is supported by the seat, the first connecting device includes a stopping wall extending out from the outer side face of one of the side walls, an arm extending from a free end of the stopping wall to correspond to the extension of the second connecting device from another receptacle when stacked thereabove and a tapered bottom side formed on a bottom face of the arm of the first connecting device to correspond to the reduced bottom side of a second connecting device from another receptacle when stacked thereabove such that the first connecting device is able to engage with a second connecting device from another receptacle when stacked thereabove; and a first boss is formed on the outer side face of each of the side walls and a second boss is formed adjacent to the extension to correspond to and selectively abuttale to the first boss so as to secure engagement between the first connecting device and a second connecting device from another receptacle stacked thereabove when the arm of the first connecting device is received in a space defined by the engaging wall and the extension of a second connecting device from another receptacle stacked thereabove.

2. The receptacle as claimed in claim 1, wherein the pouch-like body has multiple retainers formed on an inner face thereof and a baffle received in the pouch-like body to be supported by the retainers so as to divide an interior of the pouch-like body into two compartments.

* * * * *